US006660219B1

(12) United States Patent
Schubert et al.

(10) Patent No.: US 6,660,219 B1
(45) Date of Patent: Dec. 9, 2003

(54) METHOD AND DEVICE FOR EMPTYING METALLURGIC MELTING VESSELS BY TIPPING

(75) Inventors: Manfred Schubert, Oberhausen (DE); Peter Starke, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 106 days.

(21) Appl. No.: 09/980,245

(22) PCT Filed: Jun. 5, 2000

(86) PCT No.: PCT/EP00/05089

§ 371 (c)(1),
(2), (4) Date: Feb. 28, 2002

(87) PCT Pub. No.: WO00/75587

PCT Pub. Date: Dec. 14, 2000

(30) Foreign Application Priority Data

Jun. 4, 1999 (DE) ..... 199 25 550

(51) Int. Cl.[7] ..... F27D 23/00; C21B 7/14

(52) U.S. Cl. ..... 266/45; 266/240; 222/590; 222/604; 373/84; 373/115

(58) Field of Search ..... 266/45, 240; 222/590, 222/604; 373/84, 115

(56) References Cited

U.S. PATENT DOCUMENTS

| | | | | |
|---|---|---|---|---|
| 2,268,918 A | | 1/1942 | Allan et al. | |
| 3,310,298 A | * | 3/1967 | Huwyler et al. | 266/240 |
| 5,227,119 A | * | 7/1993 | Zalner et al. | 266/241 |

FOREIGN PATENT DOCUMENTS

| | | |
|---|---|---|
| DE | 262543 | 3/1912 |
| DE | 4006281 | 8/1991 |
| GB | 741035 | 11/1953 |

* cited by examiner

*Primary Examiner*—Melvyn Andrews
(74) *Attorney, Agent, or Firm*—Friedrich Kueffner

(57) ABSTRACT

The invention relates to the emptying of melting vessels (1) by tipping. According to the invention, the melting vessel (1) is placed on column-shaped bases (6). During the tipping process, the melting vessel (1) is raised at the side and the base supports (7) of the opposite side are used as the pivot or axis of rotation. This ensures that the discharge opening (4) and the slag overflow edge (5) are not moved very far from their original position.

5 Claims, 1 Drawing Sheet

METHOD AND DEVICE FOR EMPTYING METALLURGIC MELTING VESSELS BY TIPPING

Figure 1:
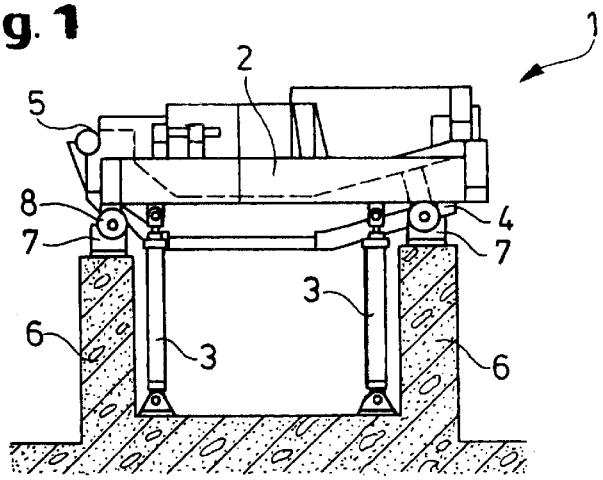

The invention relates to a method and a device for emptying metallurgical melting vessels by tipping, such as, for example, electric arc melting furnaces and resistance melting furnaces, comprising a lower furnace frame resting on a foundation, a tilting device, a closeable tapping opening arranged in the furnace bottom, and a slag overflow edge arranged laterally on the furnace.

When performing thermal metallurgical reactions of metals in metallurgical melting vessels, after completion of these reactions the metals are present in a molten state, overlaid with molten slag. For removal of the slag as well as for emptying the molten mass into a ladle, these metallurgical melting vessels are usually provided with a tilting device with which the entire melting vessels can be brought from its initial horizontal rest position into a slanted position.

In a three-phase current arc furnace known from DE 32 41 987 C2 the furnace vessel is positioned with a lower furnace frame on two tilting cradles. Upon tilting of the furnace, the toothed circularly configured tilting cradle rolls on a horizontal substructure which is also toothed, wherein disadvantageously the tapping opening during tilting moves away from the center of the furnace.

In a configuration of a melting vessel known from DE 42 44 228 C2, the tilting cradle of the furnace is of a circular arc shape and supported on rolls which are rotatably supported on foundation frame resting on the furnace foundation. For stabilizing the furnace, it is supported additionally by at least one hydraulic tilting cylinder. With the described embodiment of the melting vessel, it is tiltable in both directions for slag removal and for steel tapping wherein the center of the scrap metal chute is also the pivot point of the melting vessel during the tilting movement. Moreover, on the tilting cradle supported on the rolls a cam is provided in a defined area which, upon surpassing a tilting range, rests against the roll on the slag removal side and moves along in the upward direction.

A disadvantage of these known configurations of the tilting devices with a lower furnace frame supported on cradles is that the position of the tapping opening and the slag overflow edge is greatly changed upon tilting and results, for example, in great distances between the melting vessel and the tapping opening and thus favors nitrogen uptake during tapping. Moreover, the tilting cylinders stabilizing the furnace, which is supported on rolls, are disadvantageously loaded during the furnace operation by impacts and vibrations caused during the charging and the melting process.

It is an object of the invention, based on the known prior art, to provide a method and a device for emptying metallurgical melting vessel by tipping, by which the described disadvantages, in particular, the positional change of the tapping opening and of the slag overflow edge, occurring during the tilting movement are substantially prevented.

This object is solved for metallurgical melting vessels of the aforementioned kind with the characterizing features of claims 1 and 2. Advantageous embodiments of the invention are provided in the dependent claims.

According to the invention, one side of the lower furnace frame of the melting vessel is lifted off its base supports, on which the lower furnace frame rests in the rest position of the melting vessel, and is tilted about the oppositely positioned base supports acting as a pivot point or axis of rotation. The base supports which are arranged at the upper end of column-shaped bases are shell-shaped. In these shell-shaped base supports the lower furnace frame is supported by means of its support elements rotatably embodied in the base supports.

The column-shaped bases have correlated therewith tilting cylinders which enable lifting of any individual side of the lower furnace frame or of the entire melting vessel by means of a tilting movement (rotary movement) about the oppositely positioned base supports, respectively, acting as a pivot point or axis of rotation.

According to an advantageous embodiment of the invention, the tapping opening and the slag overflow edge are arranged in immediate vicinity of this axis of rotation so that during the tilting process advantageously no or only an insignificant change of the position of the tapping opening and of the slag overflow edge will occur.

According to a further advantageous embodiment of the invention, the tapping opening and the slag overflow edge are arranged on the melting vessel such that the slag removal as well as emptying of the molten mass is possible by a tilting movement to only one side. In this connection, the tapping opening is advantageously arranged in this connection such that in the rest position of the is melting vessel it is above the level of the liquid residual sump remaining after tapping.

The tilting cylinders which during the tilting process must support a portion of the furnace weight and must therefore be dimensioned of a corresponding strength are completely relieved in the rest position of the melting vessel in which the melting vessel rests on all base supports.

Further advantages, details, and features of the invention will be explained in more detail in the following with an embodiment illustrated in the drawing figures.

Figure 2:
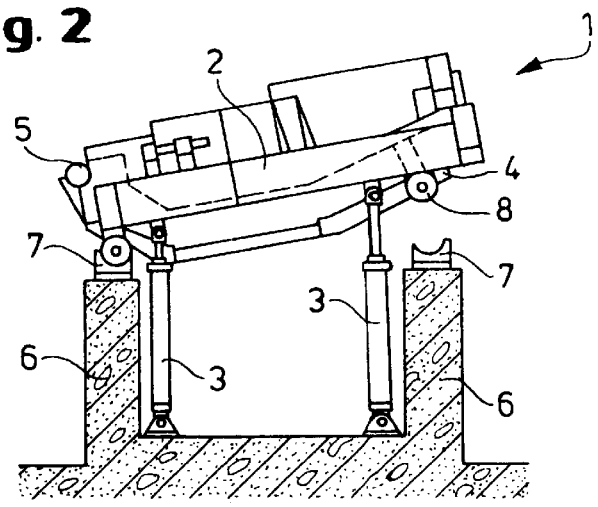
Figure 3:
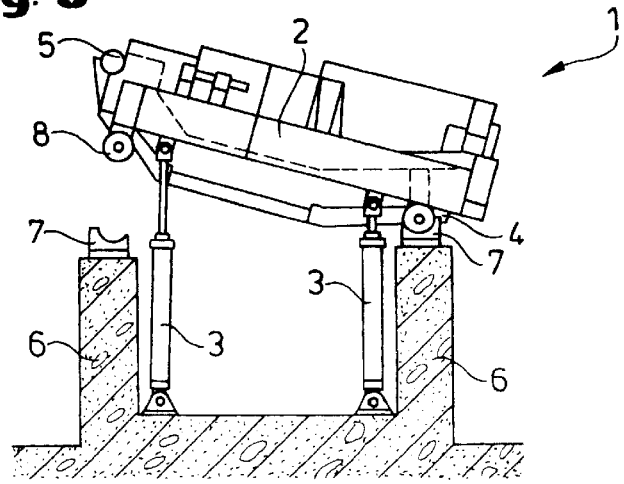

It is shown in:

FIG. 1 a melting vessel according to the invention in its rest position;

FIG. 2 a melting vessel according to FIG. 1 tilted for removal of slag;

FIG. 3 a melting vessel according to FIG. 1 tilted for emptying the molten mass.

In FIG. 1 a melting vessel 1 according to the invention is illustrated in its rest position. The melting vessel 1 rests in this connection with the support elements 8 of the lower furnace 2 on the base supports 7 which are shell-shaped and which form the upper end of the column-shaped bases 6. In immediate vicinity of the bases 6, a tilting cylinder 3 is provided, respectively, which in the illustrated rest position is completely relieved because the lower furnace frame 2 rests on all base supports 7 that are present. The bases 6 are arranged with their base supports 7 such that they extend as closely as possible to the slag overflow edge 5 (to the left in the drawing figure) and the tapping opening 4 (to the right in the drawing figure).

In FIG. 2 the melting vessel 1 has been lifted or tilted for the purpose of slag removal by lifting the lower furnace frame 2 by means of the tilting cylinders 3 arranged to the right. While the right part of the lower furnace frame 2 with the tapping opening 4 is lifted off the base supports, the left part of the lower furnace frame 2 with its support elements 8 is rotated within the left base supports 7 which represent thus the pivot point or the axis of rotation. The slag overflow edge 5 hardly changes its position as a result of the illustrated tilting process relative to the initial position in the rest position according to FIG. 1 because the slag overflow edge 5 is positioned in the immediate vicinity of the axis of rotation of the base supports 7.

In FIG. 3 the position tilted to the opposite side compared to FIG. 2 is illustrated. The left side of the lower furnace frame 2 is lifted in order to tap the molten mass from the melting vessel 1 via the tapping opening 4. In this embodiment, the position of the tapping opening 4 is basically not changed by the tilting movement because the tapping opening 4 practically coincides with the axis of rotation of the base supports 7.

In the illustrated embodiment the tilting to two oppositely positioned sides is illustrated. Depending on the configuration of the melting vessel 1, it is also possible according to the invention to tilt only to one side. The configuration of the tilting device according to the invention moreover makes it possible to perform the tilting process to any side which is advantageous, for example, with regard to repairs and maintenance work.

What is claimed is:

1. Method for emptying metallurgical melting vessels by tilting, such as, for example, electric arc melting furnaces and electric resistance melting furnaces, comprising a lower furnace frame resting on a base, a tilting device, a closeable tapping opening arranged within the furnace bottom, and a slag overflow edge arranged laterally on the furnace, wherein the melting vessel (1) is released laterally from the base supports (7) by lifting the side of the lower furnace frame (2) opposite the tapping opening (4) or opposite the slag overflow edge (5) and tilted about the oppositely positioned base supports (7) acting as pivot point or axis of rotation, wherein the position of the tapping opening (4) and/or of the slag overflow edge (5) during the tilting process is not changed or changed only insignificantly.

2. Device for emptying metallurgical melting vessels (1) by tilting, such as, for example, electric arc melting furnaces and electric resistance melting furnaces, comprising a lower furnace frame (2) resting on a base (6), a tilting device, a closeable tapping opening (4) arranged within the furnace bottom, and a slag overflow edge (5) laterally arranged on the furnace (1), for performing the method according to claim 1, wherein column-shaped bases (6) with supports (7) that are shell-shaped at their upper end, on which the lower furnace frame (2) in the rest position of the furnace is rotatably supported by means of its support elements (8) matched to the shape of the base supports (7) and on which the lower furnace frame (2), using the base supports (7) as pivot points or axis of rotation, is supported with one side upon tilting, and tilting cylinders (3) correlated with the column-shaped bases (6) by means of which the lower furnace frame (2) can be tilted to any side by lateral lifting.

3. Device according to claim 2, wherein the column-shaped bases (6) with their base supports (7), forming the pivot points or the axes of rotation, are arranged in immediate vicinity of the lower edge of the tapping opening (4) or of the slag overflow edge (5).

4. Device according to claim 2, wherein the tapping opening (4) and the slag overflow edge (5) are arranged on the melting vessel (1) such that tilting is required only to a common side.

5. Device according to claim 2, wherein in the furnace rest position the tapping opening (4) is above the level of the liquid residual sump remaining after tapping.

* * * * *